US007134988B2

(12) United States Patent
Van Straaten et al.

(10) Patent No.: US 7,134,988 B2
(45) **Date of Patent: *Nov. 14, 2006**

(54) EXERCISE AID

(75) Inventors: Willem Johannes Van Straaten, Sandton (ZA); Christopher Lundin, Newark, DE (US)

(73) Assignee: Greenhouse International LLC, Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/888,973

(22) Filed: Jul. 13, 2004

(65) Prior Publication Data

US 2006/0014613 A1 Jan. 19, 2006

(51) Int. Cl.
*A63B 26/00* (2006.01)

(52) U.S. Cl. ..... 482/142; 21/676; 21/686

(58) Field of Classification Search ..... 482/142, 482/23–28, 907

See application file for complete search history.

(56) References Cited

U.S. PATENT DOCUMENTS

| | | | | | |
|---|---|---|---|---|---|
| 3,408,107 | A | * | 10/1968 | Savage | 297/452.41 |
| 3,499,682 | A | * | 3/1970 | Orenstein | 297/452.41 |
| 3,760,801 | A | * | 9/1973 | Borgeas | 601/149 |
| 4,962,921 | A | * | 10/1990 | Simmons | 472/129 |
| 5,033,742 | A | * | 7/1991 | Johnson et al. | 482/140 |

* cited by examiner

*Primary Examiner*—Lori Amerson
(74) *Attorney, Agent, or Firm*—Wenderoth, Lind & Ponack, L.L.P.

(57) ABSTRACT

An exercise aid which includes an inflatable body which has an outer surface, and at least one inflatable component on at least part of the outer surface.

31 Claims, 6 Drawing Sheets

EXERCISE AID

BACKGROUND OF THE INVENTION

This invention relates to an exercise aid which can be utilised in diverse ways by a person who is exercising e.g. to assist with stretching and body toning exercises, to provide a support on which exercises are done or while a user is weight training, and so on. The scope of the invention is not limited in any way by the manner in which the exercise aid is used.

SUMMARY OF INVENTION

The invention provides an exercise aid which includes an inflatable body which has an outer surface, and at least one inflatable component on at least part of the outer surface.

The inflatable body may have a ground-engaging lower side of any suitable shape or form. For example the lower side may be flat or it may be outwardly curved in two or three dimensions.

The inflatable component or a plurality of inflatable components may be positioned over all or any part of the outer surface of the inflatable body. It is preferred however to make use of the inflatable component, or a plurality of the inflatable components, on what, in use, is an upper side of the body.

The inflatable component may be partitioned into a plurality of segments to give a bubble-like surface finish of any suitable shape and size to the inflatable body or at least part thereof.

The segments may extend substantially over all of the upper surface or, alternatively, may be provided in a plurality of arrays which are spaced from each other and which are positioned on the upper surface. The segments may be varied in shape, size and position for aesthetic reasons, to provide support for a user, to provide a low-slip surface, or the like.

In one form of the invention at least one inflatable component or at least part of an inflatable component is positioned and shaped to form a headrest for a user on the body.

The body may have an upper side which includes a seat region and the inflatable component may be located on an upper side of the body adjacent the seat region. The seat region may be defined by a recessed region. The inflatable component may be positioned so that, in use, it is adapted to provide support for a back, or part of the back, of a user.

In variations of the invention the upper side is generally concave, or convex, with one or more inflatable components strategically positioned and shaped to provide a required degree of support.

It is also possible to provide an inflatable component, again preferably partitioned into a plurality of segments, at a position on the upper side so that the inflatable component provides support for one or both thighs or upper legs of a user.

The inflatable component may be connected to the body so that the body and the inflatable component are inflatable in unison. Alternatively the inflatable component is made so that it is inflatable separately from the body.

At least an upper side of the body may be made from a first sheet of flexible material. The inflatable component may be formed by at least a second sheet of flexible material which is secured to the first sheet of flexible material to form pockets or enclosures which can be inflated either together with the body or separately therefrom and which define the segments.

In a variation of the invention a component is formed which is inflatable separately from the body and the component is then attached to the body in any appropriate way. In other words although the component is secured to the body, the component and the body are formed from separate elements, e.g. sheet material.

In a preferred version of the invention the upper side comprises at least a first sheet of flexible material and the inflatable component is formed by at least a second sheet of flexible material which is secured to the first sheet of flexible material. The material sheets may have contrasting colours to enhance the aesthetic appeal of the exercise aid. For example the body may be made from sheet material of one or more colours and the sheet material used for forming the inflatable component may be made from a contrasting colour or a transparent material.

The body is preferably made from a plastics sheet material using techniques which are known in the art and which allow adjacent portions of sheet material to be secured to each other for example by means of a welding or similar process.

The body may be inflatable via a first one-way filler valve and the inflatable component may be separately inflatable via a second one-way filler valve. It is possible though to inflate the inflatable component and the body in unison and this can be achieved by placing the inflatable component in communication with the interior of the inflatable body. An additional valve or valves may be used for rapidly deflating the body, or the inflatable component, or both, when required.

The position and shape of the inflatable component and, in particular, the position and shape of segments of the inflatable component (when it is partitioned into segments) can be varied so that a contoured support surface of any appropriate shape is provided for a user of the exercise aid. For example lumbar support may be provided by means of pockets or segments which engage with a lower back region of a user who is seated on or who is exercising on the upper surface of the body.

BRIEF DESCRIPTION OF THE DRAWINGS

The invention is further described by way of examples with reference to the accompanying drawings in which.

DESCRIPTION OF PREFERRED EMBODIMENTS

Figure 1:
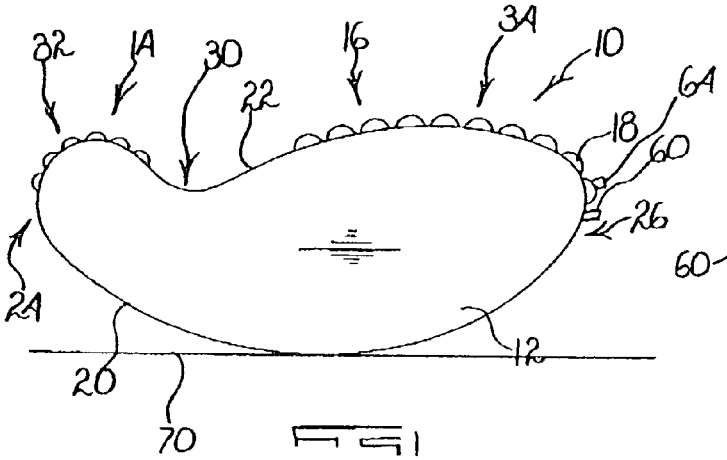
FIG. 1 is a side view of an exercise aid according to one form of the invention.

FIGS. 1 to 4 of the accompanying drawings illustrate an exercise aid 10 according to a first form of the invention from one side, in plan, from an end and in perspective, respectively.

The exercise aid includes a body 12 and inflatable components 14 and 16 respectively with each component being divided into a plurality of segments 18 each in the nature of a flattish, rectangular bubble.

The body 12 is made from a tough flexible plastics sheet material. This type of material, which is known in the art, can, within reason, be formed into any appropriate shape. Overlapping sheets of the material can be secured to one another in a leak-proof manner using welding or similar techniques which are also known in the art.

The body 12 has a lower ground-engaging side 20 and an upper side or surface 22. The side 20 is curved outwardly from one end 24 of the body to an opposing end 26 of the body. The lower side 20 is convex, in the stated direction, but the degree of curvature can be varied according to requirement. In a transverse direction, see FIG. 3, the lower side 20 is substantially linear or flat.

Similarly in respect of the upper side 22, the body is curved in a complex manner proceeding from the side 24 to the side 26. Referring to FIG. 1 the body has a recessed seat region 30 and is curved outwardly between the seat region and the end 24 to provide a thigh-or leg-engaging region 32. On an opposed side of the seat region the upper surface 22 is also curved outwardly, although in a less pronounced manner, to provide a back-engaging region 34 which extends to the end 26.

Figure 3:
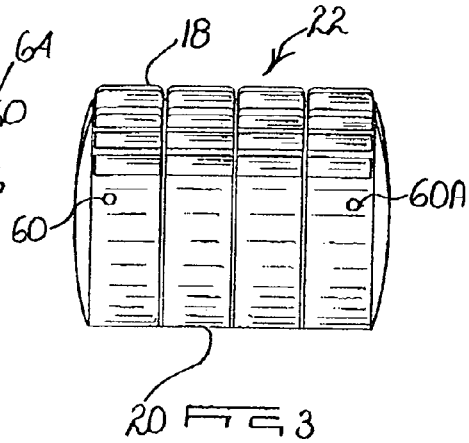
FIG. 3 is a view from one end, in the direction of an arrow marked 3, of the exercise aid shown in FIG. 1.
Figure 2:
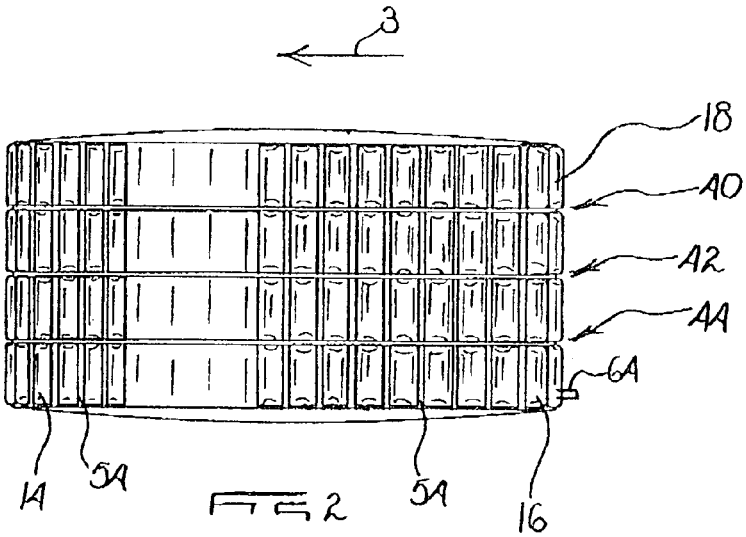
FIG. 2 is a plan view of the exercise aid shown in FIG. 1.

Referring to FIG. 3 it is to be noted that the upper side 22 is substantially flat or linear in a direction which is transverse to the direction between the ends 24 and 26.

The body 12 is made from a flexible sheet material which is inflated. Clearly there is a tendency for the material to bulge outwardly as air pressure inside the body increases. Thus although the body, within reason, can be contoured to any appropriate shape a surface which, nominally, would be flat or linear will still tend to curve outwardly slightly.

The body 12 is internally braced by means of panels, of a desired profile, which are welded internally to the sheet material which makes up the body. In the FIG. 1 embodiment there are three panels (not shown) which are positioned, inside the body, at respective locations 40, 42 and 44. These panels, along lines at which the panels are internally welded to the body, impart to the body a lined or ribbed appearance and help to limit distortion of the body, from an original design shape, due to internal pressure inside the body.

The segments 18 on the upper surface 22 are divided into two arrays which make up the inflatable components 14 and 16 respectively and which substantially cover the front or leg-supporting region 32 and the back-supporting region 34 respectively. Each inflatable component is formed by securing sheet material 50 to sheet material 52 which forms the upper surface of the body, see FIG. 5. The two sheets of material are welded to each other, using techniques which are known in the art, along predetermined lines 54. Practically any suitable pattern of segments can be formed on the upper surface 22 by partitioning the sheet material 50 into segments by judicious selection and placement of the weld lines 54. In this example the segments which make up the inflatable component 14 are each substantially rectangular in outline, see for example FIG. 2, and are slightly smaller than the segments which make up the inflatable component 16 and which are also rectangular.

Figure 5A:
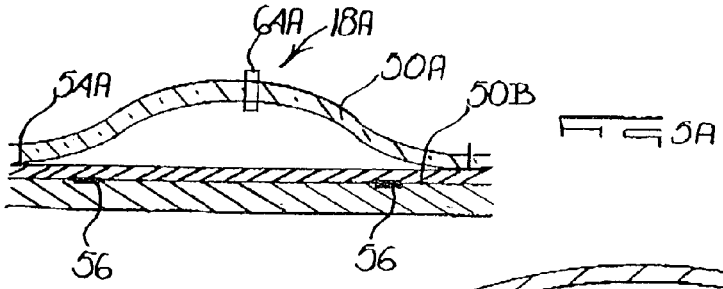
FIG. 5A shows an alternative form of construction to what is illustrated in FIG. 5.
Figure 5:
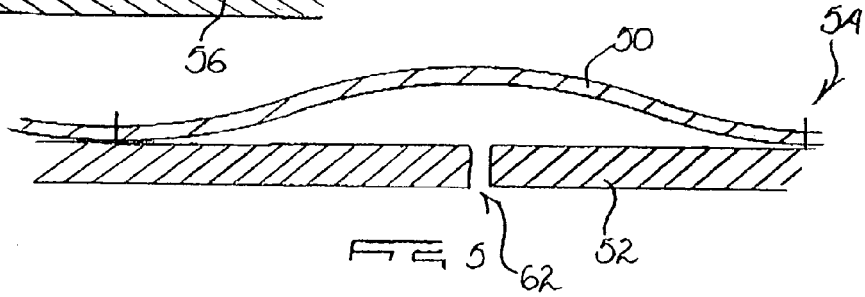
FIG. 5 is an enlarged view in cross section of part of an upper surface of the exercise aid.

FIG. 5A is similar to FIG. 5 and shows a different way of forming an inflatable component i.e. the bubble or segment structure. Two flexible plastic sheets 50A and 50B are interconnected by being welded to each other along a plurality of lines 54A to form an integral inflatable component 18A which is initially separate from the body 12 and which is then engaged with the body in any appropriate way, either in a permanent manner or in a detachable way. The component 18A could for example by attached to the body in a releasable manner by using hook and eye material 56, similar to that sold under the trade mark Velcro, or in a permanent manner by using an adhesive or welding 56. A valve 64A is connected to the component 18A and is usable to inflate the component only, without inflating the body.

The seat region 30 is substantially free of the inflatable segments although, if required, additional segments, of the same or of a different size to the segments on the remainder of the upper surface, could also be provided in the seat region.

A filler valve 60 of a type which is known in the art, provides a means whereby the body interior may be pressurised. Preferably this is done using a suitable air pump, not shown. The valve 60 could be at any suitable location. The valve 60 could be a one-way valve which allows the body interior to be pressurised and which automatically seals to limit the escape of air from the body. To allow the body to be rapidly deflected, when required, an air-escape or deflation valve 60A could be provided at a suitable location—see for example FIG. 3.

According to requirement the inflatable components 14 and 16 could be inflated in unison with the interior of the body 12. This is achieved simply by forming one or more holes 62 through the sheet material 52 in the upper side 22 (see FIG. 5A). Alternatively a separate filler valve 64 could be provided for the inflatable component 16 which is placed in air communication with the component 14 so that these components are inflated together, or each component could have a respective valve.

The exercise aid 10 can be used in a variety of ways by a person who is exercising. Typically a user is seated on the seat region 30 with the user's legs on the ground 70. Different exercises such as sit-ups, leg raises and the like can then be done. A user can also use the aid 10 as a support while doing weight-lifting or similar exercises. The exercise aid can be used to provide support during stretching and toning exercises and, if desired, the exercise aid can be turned through 180° so that the upper side 22 rests on the ground and the lower side 20 then provides a curved surface for a user to do stretching exercises, push-ups and the like. The scope of the invention is not limited in any way in this regard.

The body 12 has a large volume and consequently deforms with relative ease to adjust to the weight of a person seated or resting on the body, generally providing firm support for those portions of a user's body which come into direct contact with the exercise aid. The inflatable components 14 and 16, each of which is divided into a plurality of relatively small segments provide localised or point support for a user with each segment, if properly pressurised, tending to retain its shape. Also, to a substantial extent, the segments or bubbles tend to provide a non-slip surface for the thighs and back of a user and each segment, due to its relatively "hard" nature, provides what may loosely be referred to as a "massaging" effect.

Figure 4:
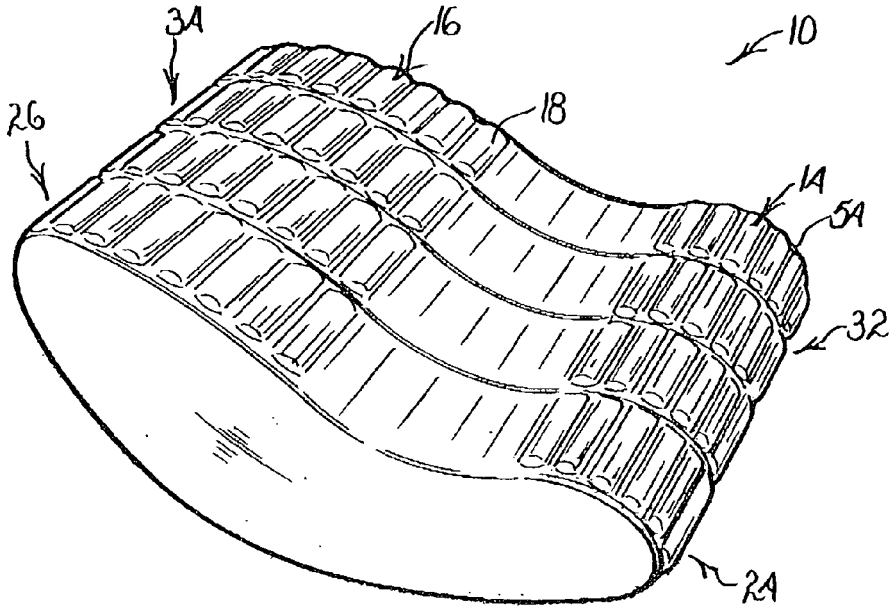
FIG. 4 is a perspective view of the exercise aid shown in FIG. 1.
Figure 6:
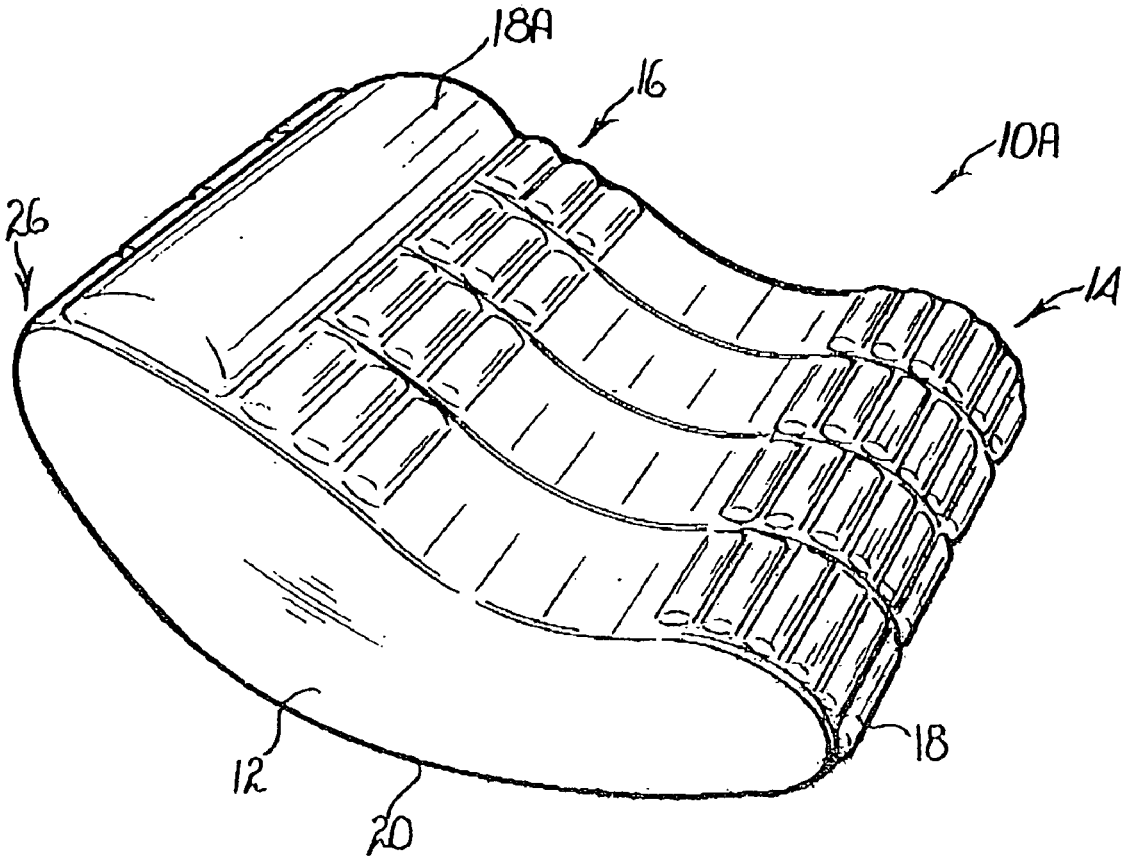
FIG. 6 is a view similar to FIG. 4 of an exercise aid according to a second form of the invention.

FIG. 6 is a view similar to FIG. 4 of an exercise aid 10A according to a variation of the invention. Many aspects of the exercise aid 10A are similar to what has been described in connection with the exercise aid 10 and these aspects are therefore not further described herein.

The exercise aid 10A includes inflatable components 14 and 16 which are partitioned into arrays of segments 18. A large segment 18A is formed in the inflatable component 16 by selectively reducing the number of weld lines in this segment array. The segment 18A is positioned close to the end 26 on what, in use, is normally a highest point of the exercise aid and the segment 18A thereby provides a headrest or support for a user.

The shape and size of the headrest can be further enhanced, if required, by using more flexible sheet material to define the segment 18A.

In each embodiment the number of internal panels, and the number, size, shape and position of the segments, can be varied according to requirement. The inflatable segments or bubbles can be provided if desired on the sides of the body or on the lower ground-engaging surface, if desired, although usually only for aesthetic reasons and can be square, round, hemispherical, oval or of any suitable shape or shapes.

Figure 7:
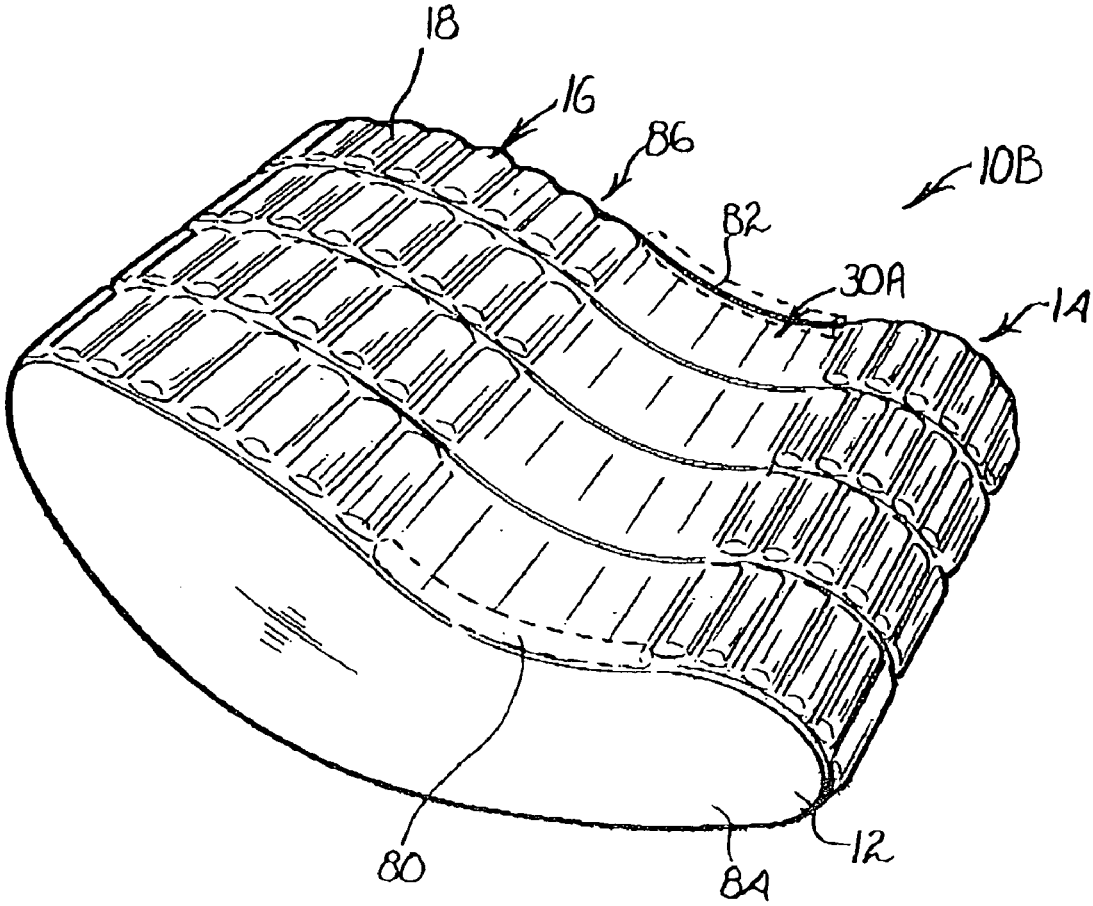
FIG. 7 is a view similar to FIG. 4 but illustrating another variation which can be included in the exercise aid of the invention.

FIG. 7 is a perspective view of an exercise aid 10B according to a further variation of the invention and again, where applicable, like reference numerals are used to designate like components. The exercise aid 10B includes a recessed seat region 30A positioned between the segments 18 which make up the inflatable component 14 and the inflatable component 16 respectively. Two elongate curved tubular segments 80 and 82 respectively, shown in dotted outline, are positioned on sides of the seat region adjacent corresponding sides 84 and 86 of the body 12. The segments 80 and 82 provide a degree of lumbar support for the sides of the lower back of a user who is seated on the region 30A.

Figure 8:
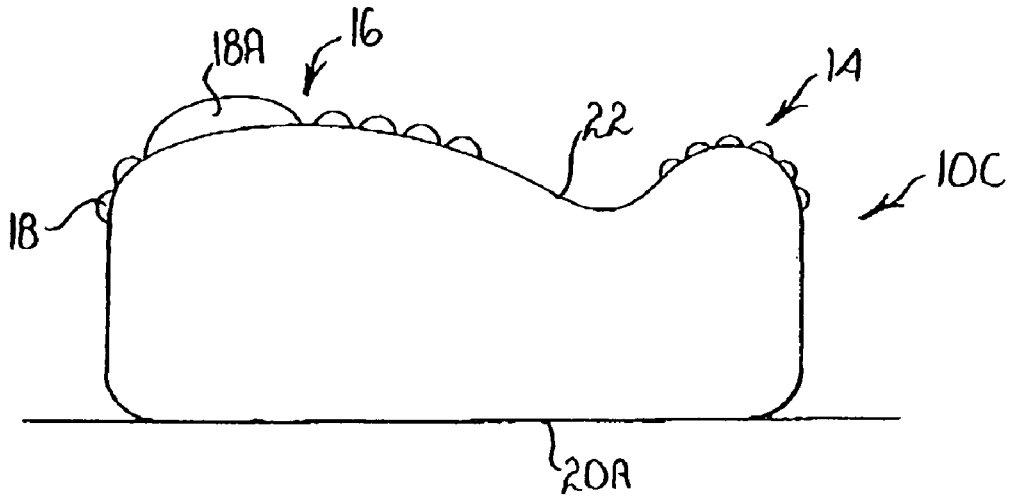
FIGS. 8, 9 and 10 respectively illustrate alternative shapes for the exercise aid of the invention.

FIG. 8 shows another variation of the invention designated 10C. The exercise aid is similar, on its upper surface, to the exercise aid 10A shown in FIG. 6 but the lower curved side 20 of the exercise aid 10A is replaced by a substantially flat or linear (non-curved) lower side 20A. This construction does limit the capability of the exercise aid to "pivot" over the ground but, on the other hand, the "flat" surface 20A provides a more stable support for a user who may be doing weight training or the like.

The upper surface 22 may also be varied in shape e.g. to be flat, or planar, inclined, or curved outwardly, with one or more inflatable components optionally partitioned or divided into segments, on all or part of the upper surface.

Figure 9:
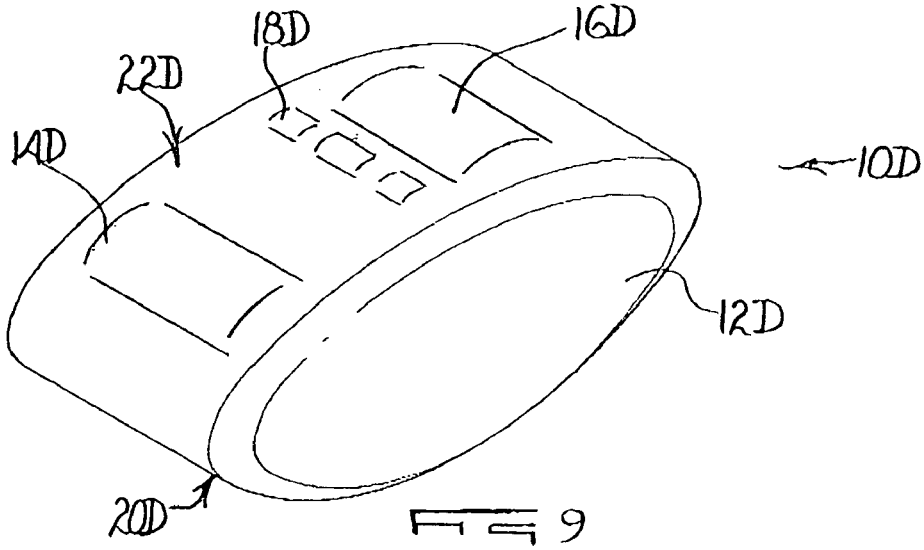

FIG. 9 is a perspective view of an exercise aid 10D, according to a variation of the invention, which has an inflatable body 12D which is substantially oval in outline, viewed from a side, with the lower side 20D and the upper side 22D each curving outwardly i.e. substantially convex, although, in a transverse direction, the lower side 20D and the upper side 22D are each nominally flat or linear. Two relatively large inflatable components 14D and 16D respectively are positioned on the upper side in order to form a region on the upper side at which a user can be seated, without easily sliding off the side, and a headrest, respectively, and a plurality of smaller inflatable segments 18D.

Figure 10:
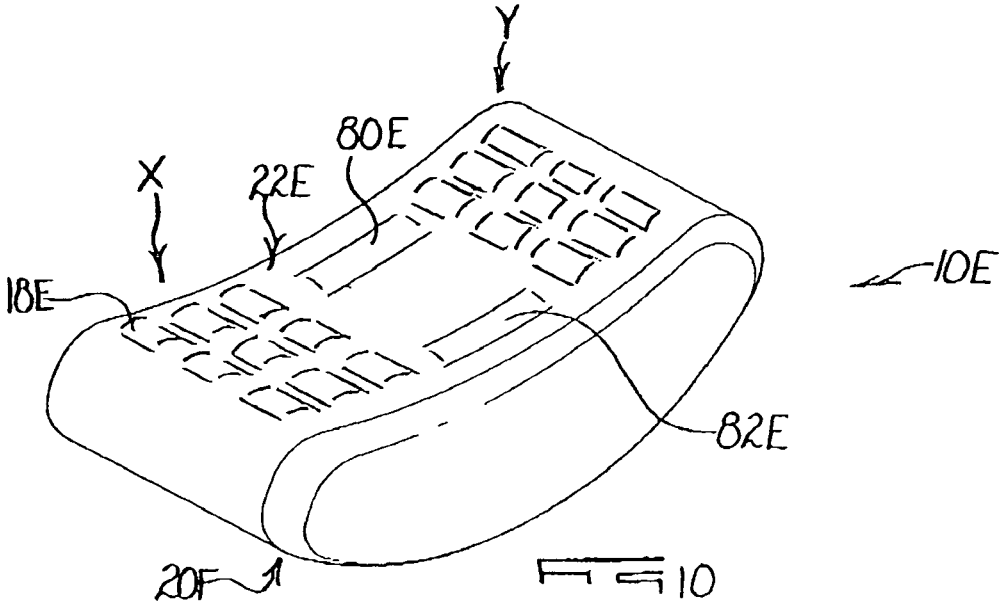

In the FIG. 10 embodiment, designated 10E, a lower side 20E is convex, while an upper side 22E is concave. An inflatable component on the upper side is partitioned into a plurality of segments 18E which are divided into two spaced arrays X and Y with lumbar support segments 80E and 82E on opposed sides of an intermediate portion of the upper side 22E.

Clearly, each variation of the exercise aid has distinctive characteristics which are largely attributable to the shape of the body. In each instance though the inflatable components or segments on the upper side contribute similar properties to the body such as localised support for a user, a non-slip surface, or the like.

The invention claimed is:

1. An exercise aid comprising:

an inflatable body having a ground engaging surface which is generally of convex form facing downwardly, and an upper side which includes a first defined region, which is recessed, for a seat of a user, the upper side including a second defined region which is curved outwardly and which forms an upper support surface upon which at least part of the back of a user is supportable at an orientation which is variable relative to the ground, and at least one inflatable component is disposed on at least part of the upper side.

2. An exercise aid according to claim 1, wherein the at least one inflatable component is partitioned into a plurality of segments.

3. An exercise aid according to claim 2, wherein the segments extend over substantially all of the upper side.

4. An exercise aid according to claim 2, wherein the segments are divided into two arrays which are spaced from each other.

5. An exercise aid according to claim 4 wherein a portion of the upper side is positioned between the two arrays.

6. An exercise aid according to claim 1, wherein at least part of the at least one inflatable component is positioned and shaped to form a head rest for a user on the body.

7. An exercise aid according to claim 1, wherein the inflatable body and the at least one inflatable component are interconnected so as to be inflatable in unison.

8. An exercise aid according to claim 1, wherein the inflatable body and the at least one inflatable component are separately inflatable.

9. An exercise aid which includes an inflatable body which has a ground-engaging side and an upper side with a recessed seat region and a thigh-engaging region adjacent the seat region, at least one inflatable component on the upper side, and a second inflatable component on at least part of the thigh-engaging region.

10. An exercise aid according to claim 9, wherein the upper side comprises at least a first sheet of flexible material, and the at least one inflatable component is formed by at least a second sheet of flexible material which is secured to the first sheet of flexible material.

11. An exercise aid according to claim 10 wherein the at least second sheet of flexible material is secured to the first sheet of flexible material at a plurality of locations so that the at least second sheet of flexible material is partitioned into a plurality of segments.

12. An exercise aid according to claim 9, wherein the upper side comprises at least a first sheet of flexible material, and the at least one inflatable component is formed by at least two interconnected sheets of flexible material.

13. An exercise aid according to claim 12 wherein the at least one inflatable component is detachably engaged with the body.

14. An exercise aid according to claim 12 wherein the at least one inflatable component is permanently attached to the body.

15. An exercise aid according to claim 9, wherein the at least one inflatable component includes a plurality of segments which are interconnected so that they are inflatable in unison.

16. An exercise aid according to claim 9, wherein the upper side includes a back-engaging region adjacent the seat region.

17. An exercise aid according to claim 16 wherein a further inflatable component is on at least part of the back-engaging region.

18. An exercise aid according to claim 17 wherein the first said inflatable component is partitioned into a plurality of segments.

19. An exercise aid according to claim 18 wherein the plurality of segments are arranged in a first array.

20. An exercise aid according to claim 17, wherein at least part of the first said inflatable component is shaped and positioned to form a head rest for a user.

21. An exercise aid according to claim 9, wherein the second inflatable component is partitioned into a plurality of segments.

22. An exercise aid according to claim 9, which includes at least third and fourth inflatable components spaced apart on opposed sides of the seat region.

23. An exercise aid according to claim 9, wherein the ground-engaging side is outwardly curved in one direction and, in a transverse direction, is substantially linear.

24. An exercise aid according to claim 9, wherein the thigh-engaging region is curved outwardly.

25. An exercise aid according to claim 16 wherein the back-engaging region is curved outwardly.

26. An exercise aid according to claim 9, wherein at least part of the upper side of the body is curved in one direction and, in a transverse direction, is substantially linear.

27. An exercise device including an inflatable or solid body comprising:

a first end;

a second end disposed opposite the first end;

a lower convex ground-engaging surface at least part of which is curved outwardly;

an upper surface that includes a first region defining a concave seat-accommodating recess for accommodating a user's seat, and a second region defining a convex back-supporting portion for supporting the user's back thereby allowing a prestretch and a full contraction of the user's abdominal muscles, wherein the concave seat-accommodating recess is located so that the user, by changing his/her center of gravity or weight distribution on the upper surface, can cause a different portion of the convex ground-engaging surface to contact the ground, and wherein the convex back-supporting portion is located adjacent the second end; and at least one inflatable component on at least part of the upper surface.

28. The exercise device as claimed in claim 27, wherein the concave seat-accommodating recess is located adjacent the first end so that the user's legs can hang over the front end and contact the ground.

29. The exercise device according to claim 27, wherein the ground-engaging surface is linear when seen in lateral cross section.

30. The exercise device as claimed in claim 27, wherein the lower convex ground-engaging surface is curved outwardly in a first direction extending between the first and second ends, and is substantially linear when viewed in cross-section taken along a second direction that is transverse to the first direction.

31. The exercise device according to claim 27, wherein the at least one inflatable component is partitioned into a plurality of segments.

* * * * *